US007650675B2

(12) United States Patent
Ida

(10) Patent No.: US 7,650,675 B2
(45) Date of Patent: Jan. 26, 2010

(54) BUCKLE

(75) Inventor: Kazuo Ida, Kurobe (JP)

(73) Assignee: YKK Corporation, Tokyo (JP)

( * ) Notice: Subject to any disclaimer, the term of this patent is extended or adjusted under 35 U.S.C. 154(b) by 285 days.

(21) Appl. No.: 11/664,961

(22) PCT Filed: Jan. 20, 2006

(86) PCT No.: PCT/JP2006/300856

§ 371 (c)(1),
(2), (4) Date: Apr. 6, 2007

(87) PCT Pub. No.: WO2006/080252

PCT Pub. Date: Aug. 3, 2006

(65) Prior Publication Data

US 2009/0007395 A1 Jan. 8, 2009

(30) Foreign Application Priority Data

Jan. 28, 2005 (JP) ..... 2005-021841

(51) Int. Cl.
*A44B 11/25* (2006.01)

(52) U.S. Cl. ..... 24/615; 24/616

(58) Field of Classification Search ..... None
See application file for complete search history.

(56) References Cited

U.S. PATENT DOCUMENTS 4,991,272 A 2/1991 Bianchi
5,440,792 A 8/1995 Ida
2005/0076483 A1* 4/2005 Chen ..... 24/615

FOREIGN PATENT DOCUMENTS

| | | |
|---|---|---|
| GB | 2 127 090 | 4/1984 |
| JP | 59-75002 | 4/1984 |
| JP | 59-130515 | 9/1984 |
| JP | 7-3320 | 1/1995 |

(Continued)

OTHER PUBLICATIONS

Office Action in corresponding Japanese Application No. 2005-021841, dated Sep. 1, 2009 (with English translation).

*Primary Examiner*—Jack W. Lavinder
(74) *Attorney, Agent, or Firm*—Alston & Bird LLP

(57) ABSTRACT

A buckle includes a plug 2 and a socket 3 connected to each other in a predetermined connecting direction. The plug 2 includes a tongue-like portion 22 and a first projected portion 23 projected from the tongue-like portion 22 in a thickness direction crossing to the connecting direction and having, thereon, a first locked face 24. The socket 3 includes an insertion hole 32 and a first stepped portion 33 formed at the insertion hole 32 and having, thereon, a first locking face 34 engaged with the first locked face 24. The buckle also includes second projected portions 25 projected from both side faces of the tongue-like portion 22 in a width direction crossing to the connecting direction and the thickness direction, second locked faces 26 formed on base end side faces of the second projected portions along the width direction, and a second stepped portion 35 formed at the insertion hole 32 and having, on its base end side faces, second locking face 36 formed along the width direction and engaged with the second locked faces 26.

3 Claims, 8 Drawing Sheets

FOREIGN PATENT DOCUMENTS

| | | | |
|---|---|---|---|
| JP | 7-9113 | | 2/1995 |
| JP | 7-26169 | | 6/1995 |
| JP | 8-52009 | | 2/1996 |
| JP | 9-308508 | | 12/1997 |
| JP | 2000-316610 | A | 11/2000 |
| JP | 3248104 | | 11/2001 |
| JP | 2002-282016 | A | 10/2002 |
| TW | 512685 | | 12/2002 |

* cited by examiner

BUCKLE

TECHNICAL FIELD

The present invention relates to a buckle. Specifically, the present invention relates to a buckle used to connect/disconnect two ends of a cord-like member or a belt, or connect/disconnect two cord-like members.

BACKGROUND ART

Buckles have been conventionally used as a means for connecting/disconnecting two ends of a cord-like member, or connecting/disconnecting two cord-like members. A conventional buckle includes a plug and a socket connected to each other in a predetermined connecting direction, and a connecting mechanism between the plug and the socket for connecting the plug and the socket to each other. The connecting mechanism has an operating section. The plug and the socket are disconnected by an external operation of the operating section. Most buckles have a flattened shape whose thickness is smaller than its length in the connecting direction and its width.

There exist cases where tensile loads are applied from the cord-like members respectively attached to the buckle and the socket to try to separate the connected plug and the socket from each other along the connecting direction.

Buckles include a front release type buckle in which the operating section is provided on its front face. The front release type buckle is disconnected by pressing the operating section toward its back face side (refer to, for example, Patent Document 1).

The connecting mechanism of the front release type buckle includes a tongue-like portion extending in the connecting direction from a base end portion of the plug, a biasing section for biasing the tongue-like portion toward the back face side of the buckle, a locking projection (operation section) projecting in the thickness direction from a tip end portion of a front face of the tongue-like portion and having a locked face along the thickness direction, an insertion hole formed in the socket along the connecting direction and having an opening in a tip end portion thereof, and a locking stepped portion formed on a front face side of the insertion hole and having a locking face along the thickness direction.

The tongue-like portion has a plate-like shape whose thickness is smaller than its length in the connecting direction and its width. The tongue-like portion can be slightly elastically deformed in the thickness direction by pressing the locking projection toward the back face side of the buckle.

In the buckle according to Patent Document 1, the tongue-like portion of the plug is inserted into the insertion hole of the socket, and the buckle is connected by engaging the locked face of the tongue-like portion and the locking face of the insertion hole with each other. When the buckle is in a connected state, the tongue-like portion is biased by the biasing section toward the front face side of the buckle inside the insertion hole, and the locked face and the locking face abut against each other face-to-face.

To disconnect such connected buckle, a user presses the locking projection toward the back face side of the buckle to deform the tip end portion of the tongue-like portion toward the back face side of the buckle. Accordingly, since the locked face is also moved toward the back face side of the buckle, the engagement between the locked face and the locking face is released. Then, all the user needs to do is to keep the locking projection pressed and separate the plug and the socket from each other along the connecting direction.

[Patent Document 1] U.S. Pat. No. 5,440,792

DISCLOSURE OF THE INVENTION

Problems to be Solved by the Invention

However, when a strong tensile load is applied to the connected buckle, the buckle may be easily disconnected due to the following effects on the plug.

When the tensile load is applied to the buckle, the tongue-like portion and the locked face of the plug are pulled toward the base end side, and at the same time, a force from the locking face is applied to the locked face to pull the locked face toward the tip end side. At this time, in the thickness direction, since the locked face is located in a front face side of the tongue-like portion and since the tongue-like portion is elastically deformable in the thickness direction, a bending moment toward the tip end side and the back face side of the buckle is generated on the locked face.

Since the bending moment acts on the locked face, the tongue-like portion is deformed toward the back face side of the buckle, and the plug inclines toward the back face side of the buckle with respect to the socket. Since the position of the locked face in the thickness direction is moved to the back face side of the buckle with respect to the position of the locked face, the face-to-face relation (i.e., the engaging relation) between the locked face and the locking face is released. Since the plug and the socket are respectively pulled by the tensile loads, the buckle is disconnected by releasing the engagement between the locked face and the locking face. Thus, when a strong tensile load acts on the connected buckle, due to the bending moment acting on the locked face, there is a concern that the buckle may be easily disconnected.

On the other hand, as a buckle in which the bending moment is hard to generate, there is a side release type buckle that has operation sections respectively on both side faces thereof, and the buckle is disconnected by pressing the operation sections against each other inwardly. However, the operation sections of such release type buckle have to be formed on both side faces, and the connecting mechanism has to have such a shape that can be elastically deformed inwardly from both sides. Since the release type buckle has the operation sections and the connecting mechanism having the aforesaid functions, it is difficult to reduce the width size thereof. In other words, the problem with the release type buckle is that it is difficult to be made small in size and light in weight.

An object of the present invention is to provide a buckle that is difficult to be inadvertently disconnected and that is small in size and light in weight.

Means for Solving the Problems

A buckle according to the present invention has a plug and a socket connected to each other in a predetermined connecting direction, in which the plug includes a plug body, a tongue-like portion extending from the plug body, and a first projected portion projecting from the tongue-like portion and having a first locked face formed thereon, the first locked face crossing the connecting direction; the socket includes a socket body, an insertion hole provided in the socket body and into which the tongue-like portion is inserted, and a first stepped portion provided at the insertion hole and having a first locking face formed thereon, the first locking face crossing the connecting direction and engaging with the first locked face; the buckle includes: a second projected portion projecting from the tongue-like portion and having a second locked face formed thereon, the second locked face crossing the connecting direction; and a second stepped portion provided at the insertion hole and having a second locking face formed thereon, the second locking face crossing the connecting direction and engaging with the second locked face, in which engaging faces of the second locked face and the second locking face are partly located on an anti-projected side of the first projected portion with respect to the first locked face.

In the buckle having such an arrangement, when the tongue-like portion of the plug is inserted into the insertion hole of the socket to connect the buckle, the plug and the socket are connected to each other by the engagement between the first locked face and the first locking face and the engagement between the second locked face and the second locking face. At this time, the first locked face and the first locking face engage with each other face-to-face along the connecting direction, and so do the second locked face and the second locking face.

When the connected plug and socket are subjected to a tensile load in a direction in which the plug and the socket are separated from each other, the following effects will be produced to the plug. When the tensile load is applied to buckle, the tongue-like portion and the first locked face of the plug are pulled toward a side opposite to the socket, and at the same time, a force from the first locking face of the socket is applied to the first locked face to pull the first locked face toward the socket side. At this time, in the tongue-like portion, since the first locked face is located on the side where the first projected portion is formed, a bending moment toward the socket side and the anti-projected side of the first projected portion is generated on the first locked face.

With such an arrangement, since the second locked face and the second locking face are engaged with each other, when the tensile load is applied to the buckle, the second locked face is acted by a force from the second locking face to pull the second locked face toward the socket side. Since the engaging faces of the first locked face and the first locking face are formed on the anti-projected side of the first projected portion with respect to the second locked face, the first locked face and the first locking face are engaged with each other near the a rotation center of the bending moment or on a side opposite to the rotation center. Further, owing to the engagement of the first locked face and the first locking face, engaging area of the engaging faces of the plug and the socket increases.

Thus, the force per unit area acted on the engaging faces of the plug and the socket becomes smaller. In other words, since the force acted on the first locking face becomes smaller, the bending moment generated on the first locking face becomes smaller. Thus, since the deformation of the tongue-like portion caused by the bending moment becomes smaller, and since the inclination of the plug relative to the socket becomes smaller, the first and second locked faces become difficult to respectively fall off from the first and second locking faces. Thus, even when a strong tensile load is applied, the buckle can be made difficult to disconnect.

Further, owing to the aforesaid advantages, the deformation of the tongue-like portion caused by the bending moment becomes smaller, and therefore the tongue-like portion is hard to damage.

Since the second locked face and the second locking face are allowed to be made extremely small compared to the buckle and are not necessary to have elasticity, it is not necessary to attach the second projected portion and the second locked face as separate components and increase the size of the buckle. In other words, the buckle not only can be made difficult to be inadvertently disconnected, but also can be made small in size and light in weight.

Since the second locked face and the second locking face have relatively simple arrangement as described above, they can be easily formed.

It is preferred that, in the buckle of the present invention, either of the first and second locked faces and the first and second locking faces are concave as extending from the plug toward the socket and are in a curved surface shape having the same center; the other of the first and second locked faces and the first and second locking faces are convex as extending from the plug toward the socket and are in a curved surface shape having the same center; and the first locked face and the first locking face have substantially the same curvature, and the second locked face and the second locking face have substantially the same curvature.

In the buckle of the present invention, there exists case where the axes of the plug and the socket along the connecting direction are out of alignment.

With such an arrangement, since the first and second locked faces respectively have the same centers as the first and second locking faces, the two locked faces formed on the plug and the two locking faces formed on the socket are integrally inclined in accordance with the inclination of the plug or the inclination of the socket respectively with the same centers. Further, since the first locked face and the first locking face have substantially the same curvature, and so do the second locked face and the second locking face, each locked face and the locking face are engaged with each other in a face contact manner. Thus, even when the axes of the plug and the socket are out of alignment, the first locked face and the first locking face can be displaced from each other smoothly while engaging with each other in a face contact manner, and so can the second locked face and the second locking face. Thus, even when the axes of the plug and the socket are out of alignment, the engaging area can be prevented from being reduced. Further, owing to such arrangement, the damage of the buckle due to force concentration can be prevented.

It is preferred that, in the buckle of the present invention, a first inclined face is formed on the first locked face, the first inclined face inclining toward a side opposite a socket side as it goes away from the tongue-like portion along a projecting direction of the first projected portion; and a second inclined face is formed on the first locking face, the second inclined face inclining toward a plug side as it goes away from the insertion hole along the projecting direction of the first projected portion.

With such an arrangement, due to the first inclined face and the second inclined face, the engaging faces of the first locking face and the first locked face incline from the socket toward the plug as they go away from the tongue-like portion along the projecting direction of the first projected portion. Owing to this inclination, the engaging area of the engaging faces of the first locked face and the first locking face increases. Further, since the insertion hole side end of the first locking face comes into the tongue-like portion side end of the first locked face, the first locked face and the first locking face are engaged with each other in a manner that they fit with each other. Thus, the first locked face and the first locking face can be securely engaged with each other.

It is preferred that the buckle of the present invention further includes: a holding piece extending from one of the plug body and the socket body toward the other of the plug body and the socket body; and a receiving face provided on the other of the plug body and the socket body and fitted by the holding piece in a state of opposing the projecting direction of the first projected portion.

With such an arrangement, the holding pieces and the receiving faces are fitted into each other in a state of facing the projecting direction of the first projected portion, in other words, contact surfaces of the holding pieces and the receiving faces cross the direction where the plug is inclined due to the bending moment generated by the first locked face. Thus, even when the plug tries to incline with respect to the socket due to being subjected to an external force or the bending moment, since the holding piece and the receiving face press each other to prevent the inclination, swing of the plug and the socket can be restrained. Thus, since the inclination of the plug relative to the socket can be reduced, the first and second locked faces become difficult to respectively fall off from the first and second locking faces. Thus, even when the plug and the socket are inclined, the buckle can be made difficult to disconnect.

EXPLANATION OF CODES

1, 1A, 1B . . . buckle, 2 . . . plug, 21, 21B . . . plug body, 212 . . . guide leg, 214 . . . receiving face, 22, 22B . . . tongue-like portion, 23 . . . first projected portion, 24 . . . first locked face, 241 . . . first inclined face, 25, 25A, 25B . . . second projected portion, 26, 26A, 26B . . . second locked face, 3 . . . socket, 31, 31B . . . socket body, 315 . . . holding piece, 32, 32B . . . insertion hole, 33 . . . first stepped portion, 34 . . . first locking face, 341 . . . second inclined face, 35 . . . second stepped portion, 36 . . . second locking face

BEST MODE FOR CARRYING OUT THE INVENTION

Embodiments of the present invention will be described below with reference to the attached drawings. Incidentally, when describing the embodiments, like components are denoted by like numerals, and the explanation thereof will be omitted.

FIRST EMBODIMENT

FIGS. 1 to 5 illustrate a first embodiment of the present invention.

Figure 1:
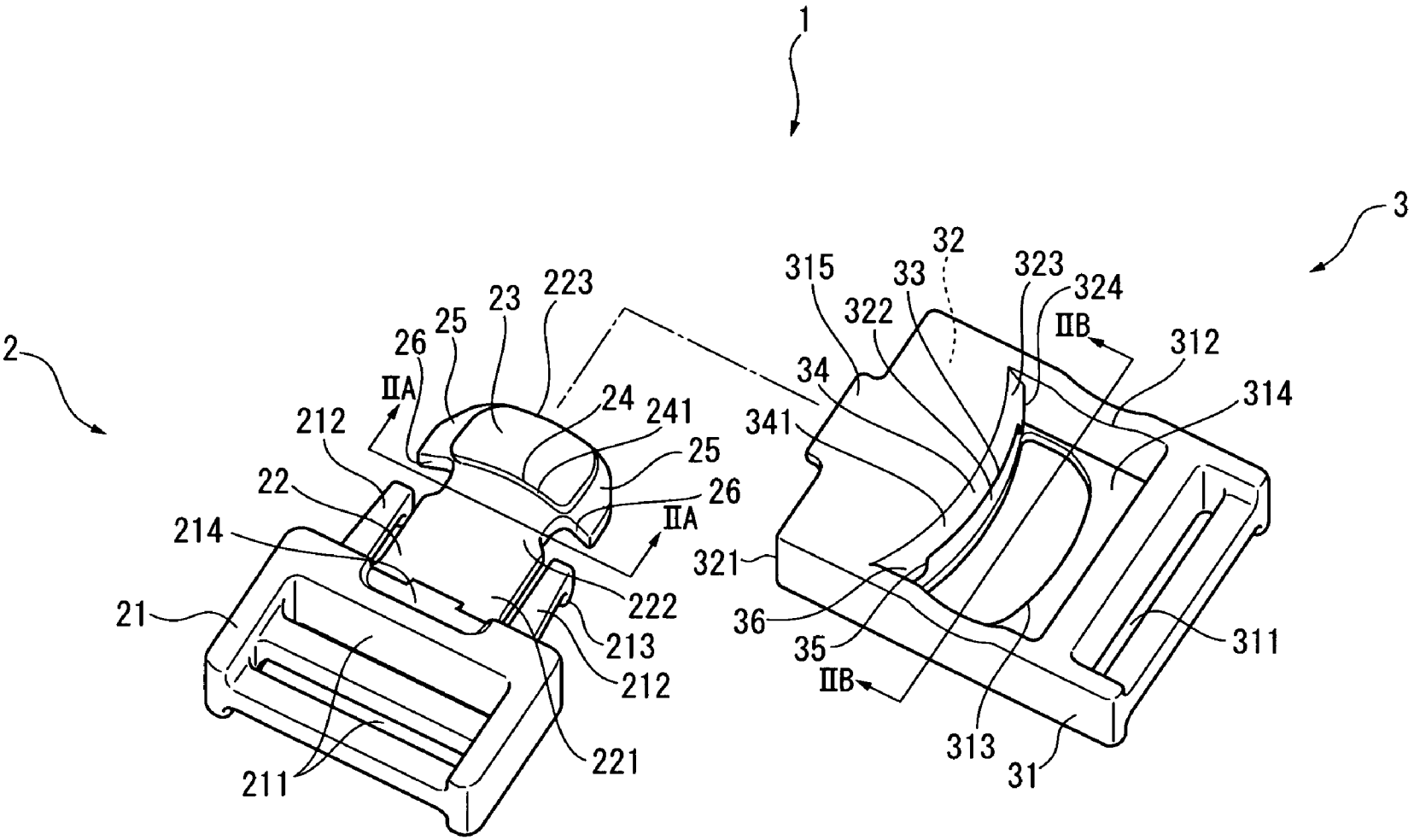
FIG. 1 is a perspective view showing a buckle in a separated state according to a first embodiment of the present invention.

As shown in these Figures, a buckle 1 of the first embodiment includes a plug 2 and a socket 3 connected with the plug 2 in a predetermined connecting direction. As shown in FIG. 1, the buckle 1 has a flattened shape whose thickness is smaller than its length in the connecting direction and its width. Herein, a thickness direction of the buckle 1 in FIG. 1 is defined as a vertical direction.

Further, in the plug 2, a side on the opposite side to the socket 3 is defined as a tip end side of the plug 2, and a side on the side of the socket 3 is defined as a base end side of the plug 2. Further, in the socket 3, a side on the opposite side to the plug 2 is defined as a base end side of the socket 3, and a side on the side of the plug 2 is defined as a tip end side of the socket 3.

The plug 2 includes a plug body 21, a tongue-like portion 22 extending from an end face of a tip end side of the plug body 21 in the connecting direction, a first projected portion 23 projected upwardly from an upper face of the tongue-like portion 22 and having, on its base end side face, a first locked face 24 formed along the vertical direction, second projected portions 25 respectively projected from both side faces of the tongue-like portion 22 in a width direction, and second locked faces 26 respectively formed on base end side faces of the second projected portions 25 along the width direction.

The plug body 21 includes, in its base end portion, a cord passing hole 211 penetrating along the vertical direction so that a strip-like element can be passed therethrough, guide legs 212 extending in parallel on both sides of the tongue-like portion 22 along the connecting direction, and two receiving faces 214 each recessed in a surface shape. The receiving faces 214 are respectively formed in a tip end edge of an upper face and a tip end edge of a lower face of the plug body 21.

Each guide leg 212 has, in its tip end portion, a leg 213 bent downwardly at substantially a right angle.

The tongue-like portion 22 includes a connecting portion 221 extending from the plug body 21 along the connecting direction, and a fan-like portion 223 formed at a tip end of the connecting portion 221 through a constricted portion 222, the fan-like portion 223 spreading out in a fan-like shape along the width direction. The tongue-like portion 22 has a plate-like shape whose thickness is smaller than its length in the connecting direction and its width, the tongue-like portion 22 being elastically deformable in the vertical direction.

The constricted portion 222 has a width smaller than that of the connecting portion 221.

A lower face of the fan-like portion 223 inclines upwardly as extending toward a tip end of the fan-like portion 223.

Figure 2A:
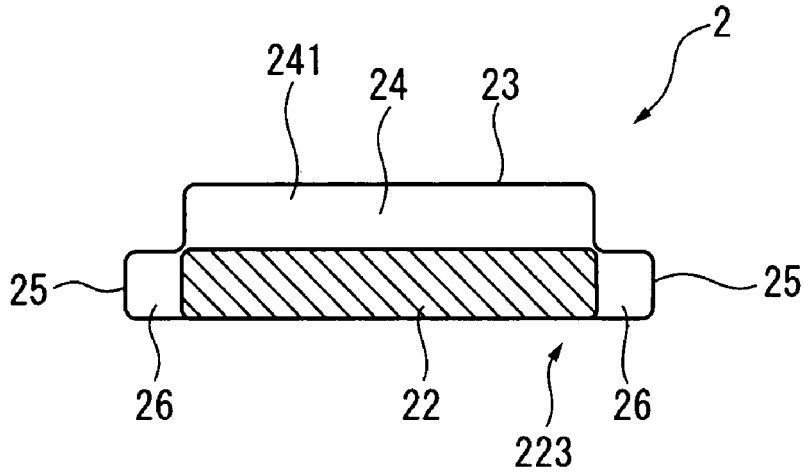
FIG. 2A is a cross section taken along line IIA-IIA of FIG. 1.

As shown in FIGS. 1 and 2A, the first projected portion 23 projects upwardly from the fan-like portion 223, and an upper face of the first projected portion 23 inclines downwardly as extending toward the tip end of the fan-like portion 223.

The first locked face 24 is formed on a base end side face of the first projected portion 23 along the vertical direction. The first locked face 24 is formed into a shape of a spherical face that is concave as extending toward the tip end of the fan-like portion 223. Further, the first locked face 24 is provided with a first inclined face 241 that inclines from a tip end side toward a base end side as it goes away from the fan-like portion 223 in the vertical direction.

As shown in FIGS. 1 and 2A, the second projected portions 25 respectively project in the width direction from both side faces of the fan-like portion 223, and a side face of each second projected portion 25 inclines toward the fan-like portion 223.

Each second locked face 26 is formed on the second projected portion 25 along the width direction, and is located below the first locked face 24. Each second locked face 26 is formed into a shape of a spherical face that is concave as extending from a tip end side toward a base end side, the spherical face having the same center as that of the first locked face 24.

As shown in FIG. 1, the socket 3 includes a socket body 31, an insertion hole 32 into which the tongue-like portion 22 and the guide leg 212 are inserted, the insertion hole 32 opening on an end face of a tip end side of the socket body 31 and being formed from the opening toward a base end side, a first stepped portion 33 formed at the insertion hole 32 and having, on its base end side, a first locking face 34 formed along the vertical direction to be engaged with the first locked face 24, and a second stepped portion 35 formed at the insertion hole 32 and having, on its base end side, two second locking faces 36 formed along the width direction to be respectively engaged with the second locked faces 26.

The socket body 31 includes, in its base end portion, a cord passing hole 311 penetrating along the vertical direction so that a strip-like element can be passed therethrough, a socket through hole 314 penetrating along the vertical direction and having an upper opening 312 and a lower opening 313, and holding pieces 315 respectively extending from a tip end side edge of an upper face and a tip end side edge of a lower face of the socket body 31.

In a connected state, the holding pieces 315 and the receiving faces 214 of the plug 2 are fitted into each other in a state of facing each other in the vertical direction.

The insertion hole 32 is formed by a tube-like portion with the connecting direction as an axis direction. The insertion hole 32 includes a tip end side opening 321 opened on an end face of the tip end side of the socket body 31, and a base end side opening 322 opened on a base end side of the socket body 31. A tube-like base end side wall 323 is formed around the base end side opening 322.

The base end side wall 323 is provided with two projecting corner portions 324 respectively protruding toward the inside of base end side opening 322 from both side corner parts of an upper wall of the base end side wall 323. The base end side wall 323 and base end side faces of the projecting corner portions 324 are formed respectively along the vertical direction and the width direction.

The first stepped portion 33 is such formed that, in the base end side opening 322, an upper inner face of the insertion hole 32 is substantially perpendicular to the upper wall of the base end side wall 323.

Figure 2B:
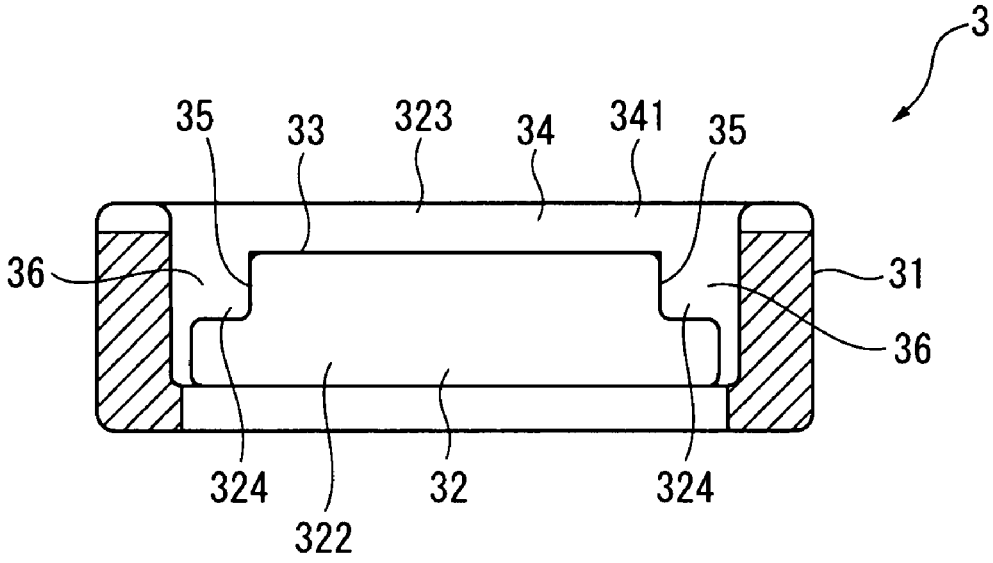
FIG. 2B is a cross section taken along line IIB-IIB of FIG. 1.

As shown in FIGS. 1 and 2B, the first locking face 34 is formed on the upper wall of the base end side wall 323. The first locking face 34 is formed into a shape of a spherical face that is convex as extending toward a base end side, the spherical face having substantially the same carvature as the first locked face 24. Further, the first locking face 34 is provided with a second inclined face 341 that inclines from a base end side toward a tip end side as it goes away from the base end side opening 322 in the vertical direction.

As shown in FIGS. 1 and 2B, the second stepped portion 35 is such formed that, in the base end side opening 322, the inner faces on both sides of the insertion hole 32 are substantially perpendicular to a base end side face of each projecting corner portion 324.

Each of the second locking faces 36 is formed on the base end side face of the projecting corner portion 324, and is located below the first locking face 34. Each second locking face 36 is formed into a shape of a spherical face that is convex as extending toward a base end side, the spherical face having substantially the same carvature as the second locked face 26 and having the same center as the first locking face 34.

Figure 3:
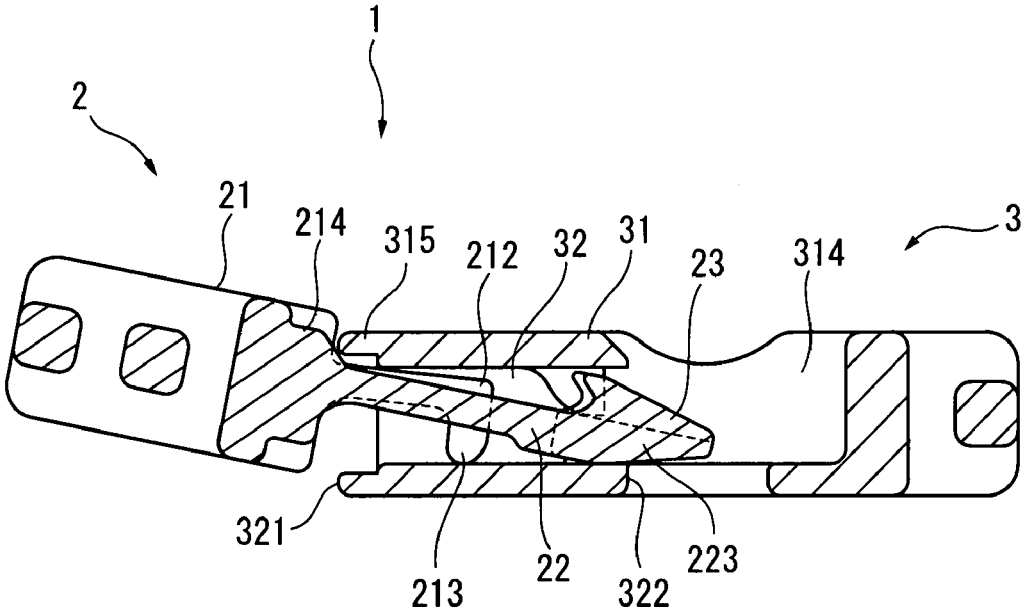
FIG. 3 is a cross section explaining connecting steps of the buckle of the aforesaid embodiment.

To connect the buckle 1 of the first embodiment, a user first holds the plug 2 and the socket 3 with his hands, and, as shown in FIG. 3, inserts the tongue-like portion 22 and the guide leg 212 of the plug 2 into the insertion hole 32 from the tip end side opening 321 of the socket 3. At this time, the tip end of the plug 2 should be inclined in such a manner that the tip end thereof is below the base end thereof so as to allow the leg 213 of the guide leg 212 to be easily inserted into the insertion hole 32. The downwardly bent legs 213 are slid against a lower inner face of the insertion hole 32. Accordingly, the tongue-like portion 22 is biased upwardly, and the upper face of the first projected portion 23 is inserted into the insertion hole 32 while being slid against an upper inner face of the insertion hole 32.

As the fan-like portion 223 of the tongue-like portion 22 gradually goes toward the base end side opening 322 of the insertion hole 32, the inclination of the plug 2 gradually becomes smaller, so that the attitude of the plug 2 gradually becomes parallel to the connecting direction. Further, since the upper face of the first projected portion 23 becomes more inclined downwardly as going toward the base end side, the upper face of the first projected portion 23 is strongly slid against the upper inner face of the insertion hole 32.

Figure 4:
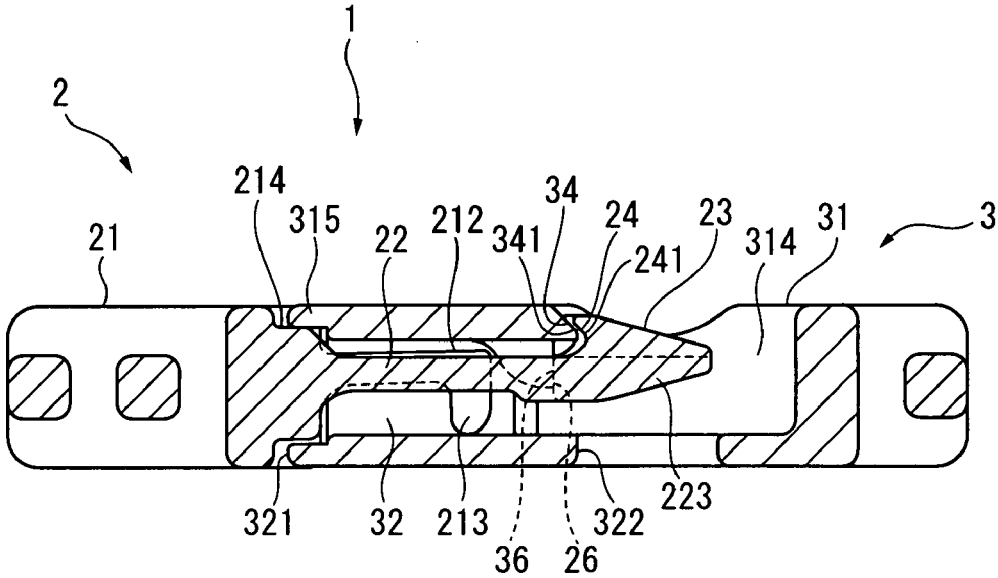
FIG. 4 is another cross section explaining connecting steps of the buckle of the aforesaid embodiment.

At this time, when the user strongly pushes the plug 2 and the socket 3 against each other in the connecting direction, the tongue-like portion 22 receives a downwardly directed force from the upper inner face of the insertion hole 32 and therefore is deformed in such a manner that the fan-like portion 223 side drops downwardly more than the plug body 21 side does. Thus, the fan-like portion 223 is inserted from the base end side opening 322 into the socket through hole 314, and the deformation of the tongue-like portion 22 is restored as shown in FIG. 4. At the same time, the receiving face 214 of the plug body 21 and the holding piece 315 of the socket body 31 are fitted into each other in a state of facing each other in the vertical direction.

Figure 5:
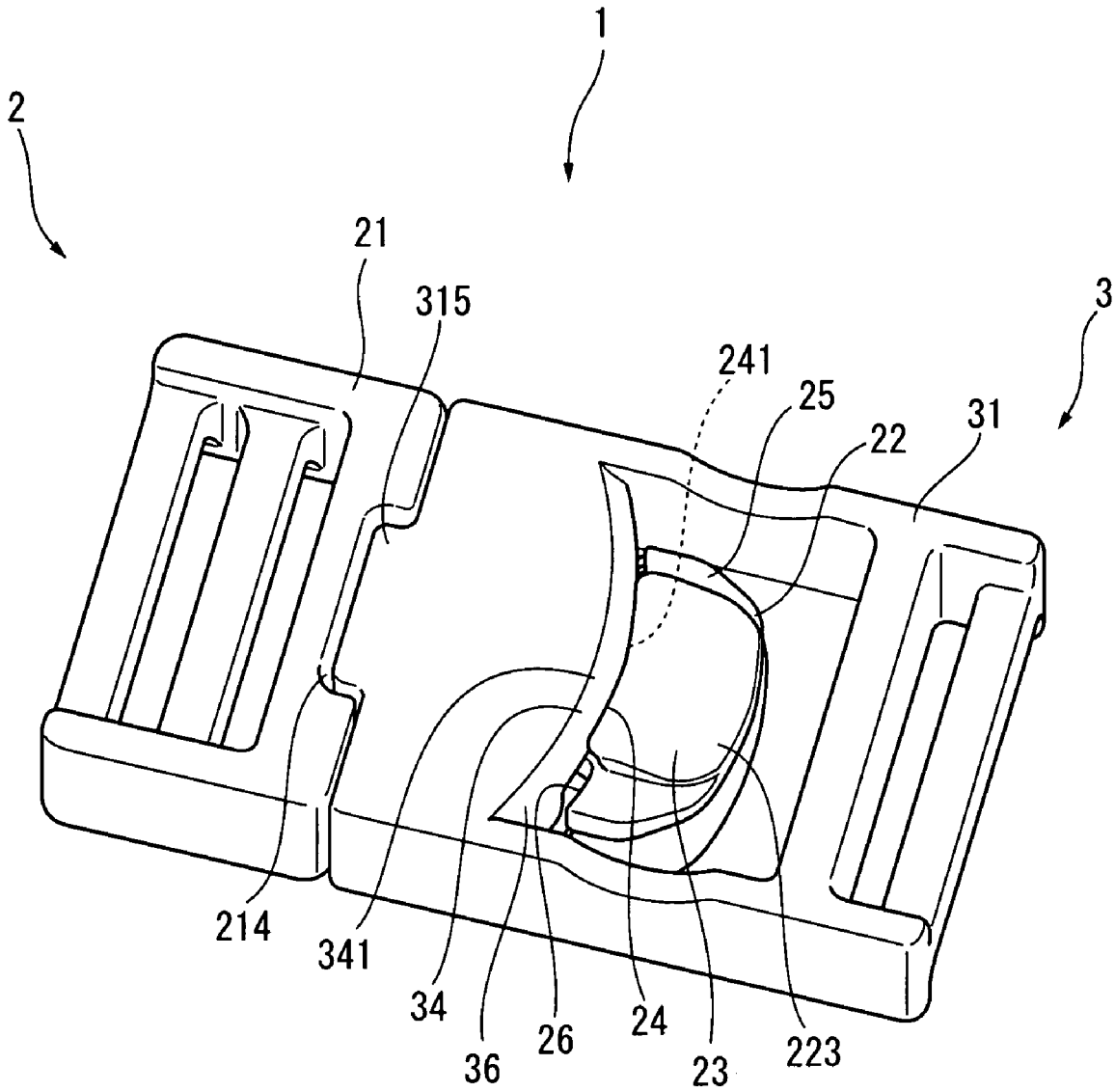
FIG. 5 is a perspective view showing the buckle in a connected state of the aforesaid embodiment.

As shown in FIGS. 4 and 5, even when the fan-like portion 223 is inserted into the socket through hole 314, since the leg 213 abuts on the lower inner face of the insertion hole 32, the tongue-like portion 22 is upwardly biased. Further, since the first locked face 24 and the first locking face 34 are engaged with each other in the connecting direction, and since the second locked face 26 and the second locking face 36 are engaged with each other in the connecting direction, the plug 2 and the socket 3 are engaged with each other, and therefore the buckle 1 is connected.

A case will be described in which a strong tensile load in the connecting direction is applied to the buckle 1 in a connected state shown in FIGS. 4 and 5, the tensile load tending to separate the plug 2 and the socket 3 from each other.

At this time, the first locked face 24 and the first locking face 34 strongly press each other in directions opposite to each other, and so do the second locked face 26 and the second locking face 36. Particularly, since the first inclined face 241 of the first locked face 24 and the second inclined face 341 of the first locking face 34 cross in the vertical direction, the first locked face 24 and the first locking face 34 abut on each other in a fitted state.

In the plug 2, the tongue-like portion 22 is pulled toward the base end side and, at the same time, the first and second locked faces 24, 26 are under forces that pull them toward the tip end side along the connecting direction. At this time, since the first locked face 24 is located above an axis of the tongue-like portion 22 along the connecting direction, a bending moment toward the tip end side and the lower side is generated on the first locked face 24.

On the other hand, since the second locked face 26 and the second locking face 36 are partly located below the axis of the tongue-like portion 22 along the connecting direction, a moment toward the tip end side and the upper side (namely a moment having the opposite direction to the aforesaid bending moment) is generated on the second locked face 26. Owing to this moment generated to the second locked face 26, the bending moment generated on the first locked face 24 is suppressed to some degree.

To disconnect the connected buckle 1, the user presses the upper face of the first projected portion 23 downwardly with his fingers. By this operation, the tongue-like portion 22 is deformed in such manner that the fan-like portion 223 side is dropped to a position lower than the plug body 21 side. At this time, the engagement between the first locked face 24 and the first locking face 34 and the engagement between the second locked face 26 and the second locking face 36 are released. Next, with the first projected portion 23 kept pressed, the user displaces the first projected portion 23 toward the base end side. By this operation, the fan-like portion 223 is brought into the insertion hole 32 from the base end side opening 322. Further, the plug 2 and the socket 3 are moved in a direction in which they are separated from each other, and the tongue-like portion 22 is pulled out from the tip end side opening 321 through the insertion hole 32. By the aforesaid operations, the buckle 1 is disconnected.

According to the first embodiment, the following advantages can be expected.

(1) Since the second locked face 26 and the second locking face 36 are engaged with each other, when the tensile load is applied to the buckle 1, the second locked face 26 receives a force from the second locking face 36 to pull the second locked face 26 toward the tip end side. Since the second locked face 26 is partly located on the side opposite to the first projected portion 23 with respect to the axis of the tongue-like portion 22, the moment having the opposite direction to the bending moment is generated on the second locked face 26. Thus, the bending moment generated on the first locked face 24 is suppressed. Since the deformation of the tongue-like portion 22 caused by the bending moment becomes smaller, and since the inclination of the plug 2 with respect to the socket 3 becomes smaller, the first and second locked faces 24, 26 become difficult to respectively fall off from the first and second locking faces 34, 36. Thus, even when a strong tensile load is applied, the buckle 1 can be difficult to be disconnected.

(2) Due to the provision of the second locked face 26 and the second locking face 36, an engaging area between the plug 2 and the socket 3 is increased, therefore when a tensile load is applied to the buckle 1, the force per unit area acting on the engaging faces of the plug 2 and the socket 3 becomes smaller. In other words, since the force acting on the first locking face 34 becomes smaller, the bending moment generated on the first locking face 34 becomes smaller. Thus, since the deformation of the tongue-like portion 22 caused by the bending moment becomes smaller, and since the inclination of the plug 2 relative to the socket 3 becomes smaller, the first and second locked faces 24, 26 become difficult to respectively fall off from the first and second locking faces 34, 36. Thus, even when a strong tensile load is applied, the buckle 1 can be difficult to be disconnected.

(3) Owing to the aforesaid advantages (1) and (2), the deformation of the tongue-like portion 22 caused by the bending moment becomes smaller, and therefore the tongue-like portion 22 is hard to be damaged.

(4) Since the second locked face 26 and the second locking face 36 are allowed to be made extremely small compared to the buckle 1 and are not necessary to have elasticity, it is not necessary to attach the second projected portion 25 and the second stepped portion 35 as separate components and increase the size of the buckle 1. In other words, the buckle 1 not only can be made difficult to be disconnected, but also can be made small in size and light in weight.

(5) Since the second locked face 26 and the second locking face 36 have relatively simple arrangements as described in the aforesaid (4), they can be easily formed.

(6) Since the first and second locked faces 24, 26 respectively have the same centers as the first and second locking faces 34, 36, the first and second locked faces 24, 26 formed on the plug 2 and the first and second locking faces 34, 36 formed on the socket 3 are integrally inclined in accordance with the inclination of the plug 2 and the inclination of the socket 3 respectively from the same centers. Further, since the first locked face 24 and the first locking face 34 have substantially the same curvature, and so do the second locked face 26 and the second locking face 36, the locked faces 24, 34 and the locking faces 26, 36 corresponding to each other are engaged with each other in a face contact manner. Thus, even when the axes of the plug 2 and the socket 3 along the connecting direction are out of alignment, the first locked face 24 and the first locking face 34 can be displaced from each other smoothly while engaging with each other in a face contact manner, and so can the second locked face 26 and the second locking face 36. Thus, even when the axes of the plug 2 and the socket 3 are out of alignment, the engaging area can be prevented from being reduced. Further, owing to such arrangement, the damage of the buckle 1 due to force concentration can be prevented.

(7) Due to the first inclined face 241 and the second inclined face 341, the engaging faces of the first locking face 34 and the first locked face 24 incline from the socket 3 toward the plug 2 as they go away from the tongue-like portion 22 along the vertical direction. Thus, the engaging area of the engaging faces of the first locked face 24 and the first locking face 34 increases. Further, since the lower end portion of the first locking face 34 comes into the lower end portion of the first locked face 24, the first locked face 24 and the first locking face 34 are engaged with each other in a manner that they fit with each other. Thus, the first locked face 24 and the first locking face 34 can be securely engaged with each other.

(8) The holding pieces 315 and the receiving faces 214 are fitted into each other in a state of facing each other in the vertical direction, in other words, contact surfaces of the holding pieces 315 and the receiving faces 214 cross to the direction in which the plug 2 is inclined due to the bending moment generated by the first locked face 24. Thus, even when the plug 2 tries to incline in the vertical direction with respect to the socket 3 due to an external force or the bending moment, since the holding piece 315 and the receiving face 214 press each other to prevent the inclination, a swing of the plug 2 and the socket 3 can be restrained. Thus, since the inclination of the plug 2 relative to the socket 3 can be reduced, the first and second locked faces 24, 26 become difficult to respectively fall off from the first and second locking faces 26, 36. Thus, even when the plug 2 and the socket 3 are inclined, the buckle 1 can be made difficult to be disconnected.

MODIFICATIONS OF FIRST EMBODIMENT

In the first embodiment, the first locked face 24 and the first locking face 34 are formed into the shape of the spherical face, and so are the second locked face 26 and the second locking face 36. However, the present invention is not limited thereto as long as the locked faces 24, 34 and the locking faces 26, 36 are easily engaged with each other in a face contact manner, the first locked face 24 and the second locked face 26 have the same center, and the first locking face 34 and the second locking face 36 have the same center. For example, the first locked face 24 and the first locking face 34 also can be formed into the shape of the conical face or the shape of cylindrical face, and so can the second locked face 26 and the second locking face 36.

Further, the present invention also includes such an arrangement in which the second locked face 26 of the plug 2 has an inclined face that inclines from a tip end side toward a base end side as it goes upwardly along the vertical direction similar to the first inclined face 241, while the second locking face 36 of the socket 3 has an inclined face that inclines from a base end side toward a tip end side as it goes upwardly along the vertical direction similarly to the second inclined face 341. With such an arrangement, the second locked face 26 and the second locking face 36 can be securely engaged with each other similarly to the aforesaid advantage (7).

SECOND EMBODIMENT

Figure 6:
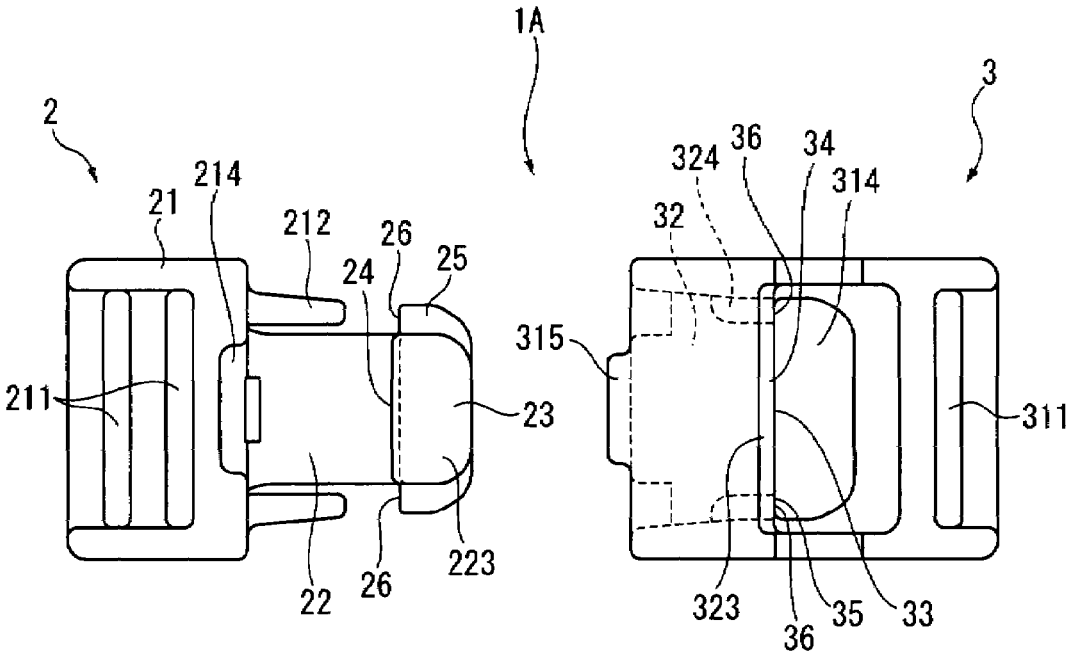
FIG. 6 is a plan view showing a buckle in a separated state according to a second embodiment of the present invention.

FIG. 6 illustrates a second embodiment of the present invention.

A buckle 1A of the second embodiment differs from the buckle 1 of the first embodiment in that, in the buckle 1A of the second embodiment, as shown in FIG. 6, the first and second locked faces 24, 26 and the first and second locking faces 34, 36 are respectively formed in a plane shape extending in the width direction.

According to the second embodiment, the following advantage can be expected in addition to the advantages (1) to (5), (7) and (8) described in the first embodiment.

(9) Since the first and second locked faces 24, 26 and the first and second locking faces 34, 36 are respectively formed in a plane shape extending in the width direction, even when the plug 2 and the socket 3 are displaced from each other in the width direction, the locked faces 24, 26 and the locking faces 34, 36 can be smoothly displaced from each other in the width direction.

THIRD EMBODIMENT

Figure 7:
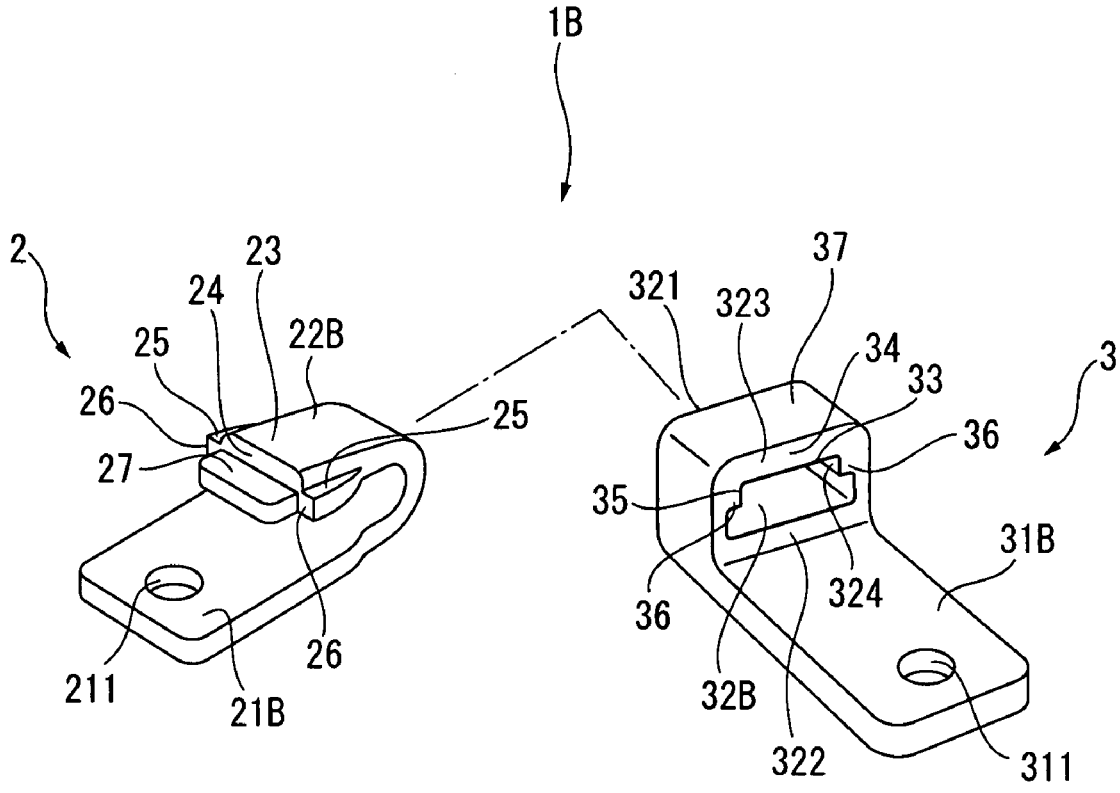
FIG. 7 is a perspective view showing a buckle in a separated state according to a third embodiment of the present invention.

FIG. 7 illustrates a third embodiment of the present invention.

As shown in FIG. 7, a buckle 1B of the third embodiment differs from the buckle 1 of the first embodiment in the following points.

A tongue-like portion 22B of the plug 2 is bent into a U-shape along the connecting direction and its end portion not connected to a plug body 21B extends upwardly. Thus, the tongue-like portion 22B can be elastically deformed in the vertical direction. Provided on an end face of the tongue-like portion 22B is an operating piece 27 extending along the connecting direction.

Due to being bent into the U-shape, the first projected portion 23 is projected from an upper face of a base end portion of the tongue-like portion 22B that faces upward.

The first and second locked faces 24, 26 and the first and second locking faces 34, 36 are respectively formed in a plane shape extending in the width direction.

A socket body 31B is a plate-like member whose longitudinal direction is the connecting direction. An insertion hole 32B is formed by an insertion tube 37 provided on a tip end side of an upper face of the socket body 31B and having the connecting direction as an axis direction. The base end side wall 323 is formed on a base end side end face of the insertion tube 37.

Further, there are no guide leg, holding piece, receiving face, and first and second inclined faces.

To connect the buckle 1B of the third embodiment, the user presses the operating piece 27 of the plug 2 downwardly to deform the tongue-like portion 22B so that the tongue-like portion 22B is shrunk in the vertical direction. Next, in a state that the operating piece 27 is pressed, the tip end portion of the tongue-like portion 22B is inserted into the insertion hole 32 formed in the insertion tube 37 of the socket 3 from the tip end side opening 321. Further, when the plug 2 and the socket 3 are pressed to each other along the connecting direction, since the tongue-like portion 22B is shrunk in the vertical direction, the tip end portion of the tongue-like portion 22B is passed through the insertion hole 32 and the base end side opening 322, and pushed to the base end side of the socket body 31B.

When the first projected portion 23 of the tongue-like portion 22B is pushed out of the base end side opening 322, the user releases his finger from the operating piece 27. In this state, the deformation of the tongue-like portion 22B is restored until the upper face of the tongue-like portion 22B abuts on the upper inner face of the insertion hole 32, yet the tongue-like portion 22B is still biased by a recovery force that tries to widen the U-shape in the vertical direction. Since the first locked face 24 and the first locking face 34 are engaged with each other in the connecting direction, and since the second locked face 26 and the second locking face 36 are engaged with each other in the connecting direction, the plug 2 and the socket 3 are engaged with each other, and therefore the buckle 1B is connected.

To disconnect the buckle 1B of the third embodiment, the user presses the first projected portion 23 downwardly to deform the tongue-like portion 22B so that the tongue-like portion 22B is shrunk in the vertical direction. At this time, the engagement between the first locked face 24 and the first locking face 34 and the engagement between the second locked face 26 and the second locking face 36 are released. Next, in a state that the first projected portion 23 is pressed, the tongue-like portion 22B is pulled out from the insertion hole 32. Thus, the buckle 1B is disconnected.

According to the third embodiment, the following advantage can be expected in addition to the advantages (1) to (5), and (9) described in the first and second embodiments.

(10) The second locked face 26 and the second locking face 36 can be formed for a small buckle having a simple structure such as the buckle 1B of the third embodiment. Thus, even when a strong tensile load is applied, the buckle 1B can be made difficult to be disconnected.

MODIFICATIONS OF FIRST AND SECOND EMBODIMENTS

It is to be understood that the present invention is not limited to the embodiments described above, and various modifications and improvements can be made as long as the objects of the present invention can be achieved.

Figure 8:
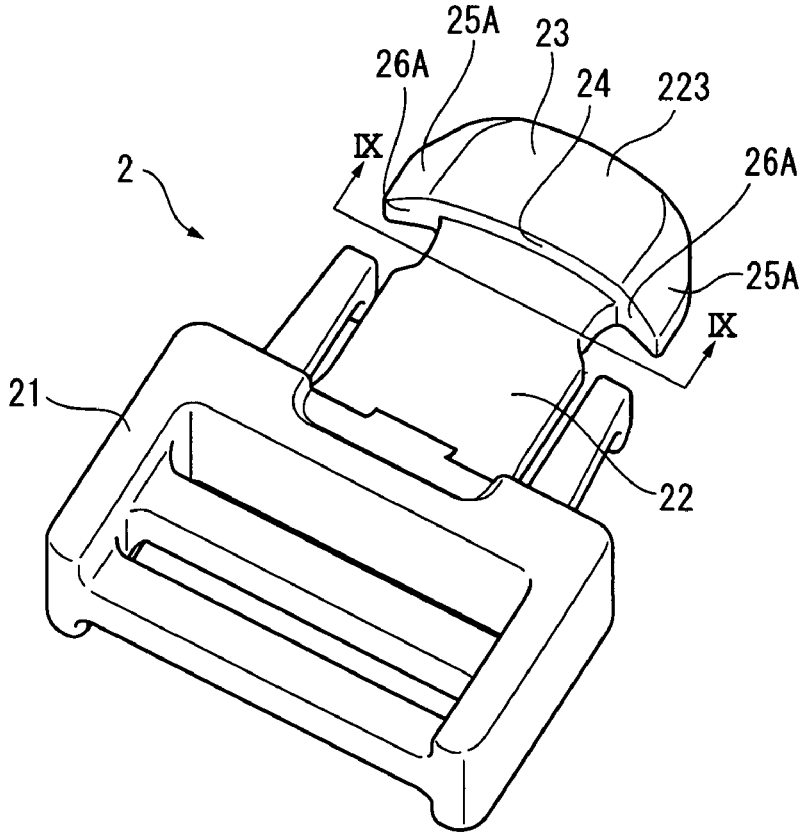
FIG. 8 is a perspective view showing a plug according to a first modification of the present invention.
Figure 9:
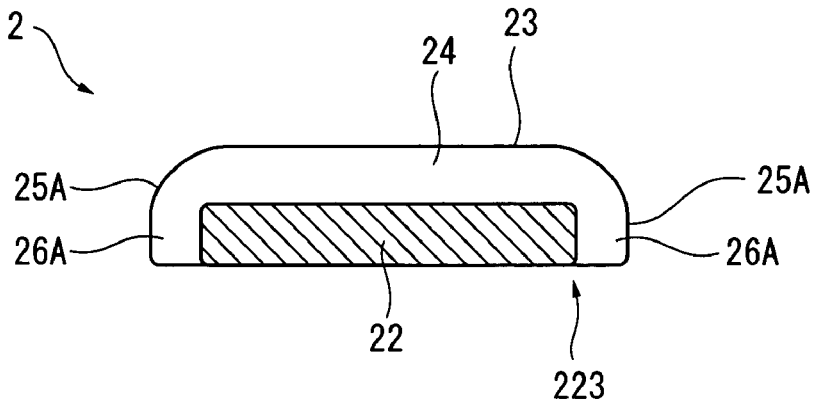
FIG. 9 is a cross section taken along line IX-IX of FIG. 8.

Although the second projected portions 25 are respectively projected in the width direction from both side faces of the fan-like portion 223 in the first to third embodiments, the present invention is not limited thereto but can have such an arrangement in which each second locked face 26 of the second projected portion 25 is partly formed below the axis of the tongue-like portion 22, 22B along the connecting direction. FIGS. 8 and 9 show a first modification in which the second projected portion 25 has a different shape, and FIGS. 10 and 11 show a second modification in which the second projected portion 25 is formed in a different position.

FIG. 8 is a perspective view showing the plug 2 of the first modification, and FIG. 9 is a cross section taken along line IX-IX of FIG. 8. As shown in these figures, second projected portions 25A of the plug 2 of the first modification have their upper end portions formed continuous with both side end portions of the first projected portion 23. Further, each continuous portion has its corner chamfered so as to have a curved shape. Thus, the first locked face 24 and a second locked face 26A are formed as a single continuous surface.

Figure 10:
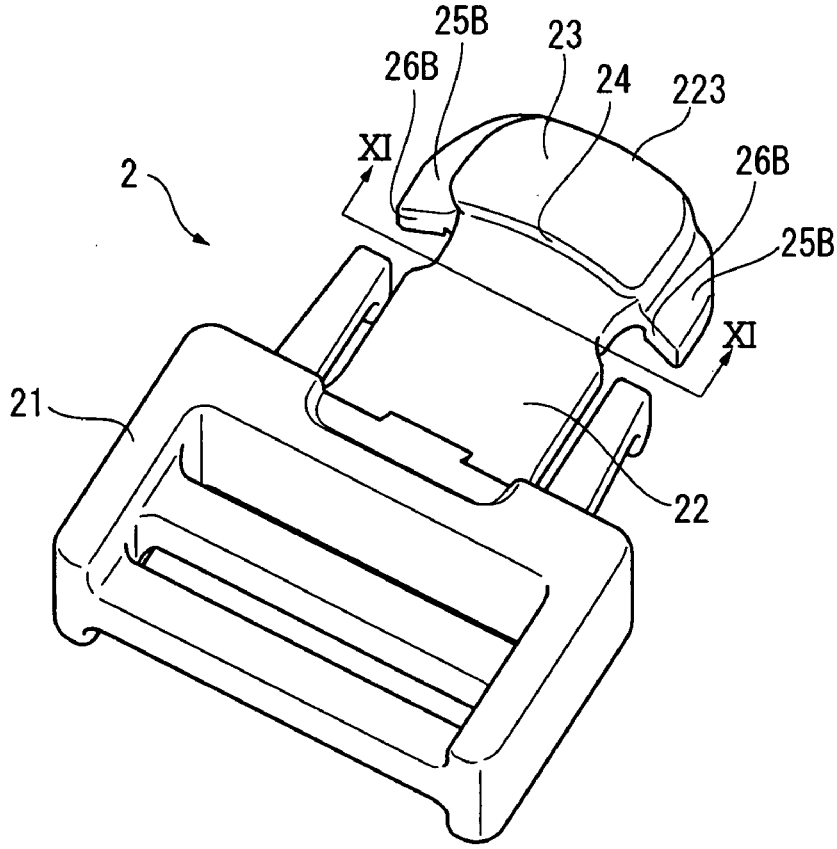
FIG. 10 is a perspective view showing a plug according to a second modification of the present invention.
Figure 11:
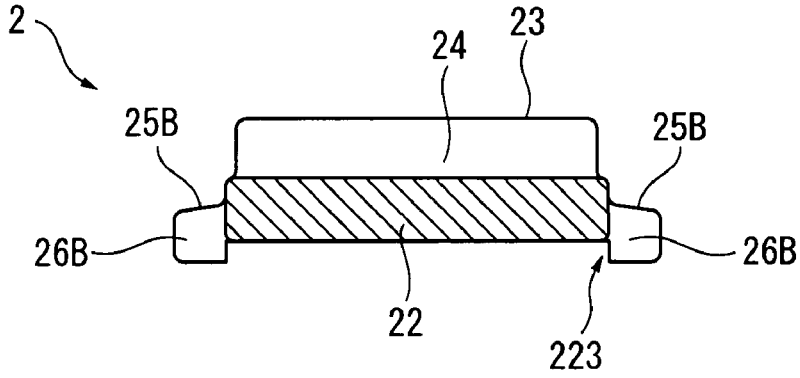
FIG. 11 is a cross section taken along line XI-XI of FIG. 10.

FIG. 10 is a perspective view showing the plug 2 of the second modification, and FIG. 11 is a cross section taken along line XI-XI of FIG. 10. As shown in these figures, each second projected portion 25B of the plug 2 of the second modification is formed at a position deviated below from the side face of the fan-like portion 223. Thus, the position of the second locked face 26B with respect to the axis of the tongue-like portion 22, 22B along the connecting direction is lower than the position of the second locked face 26 of the first to third embodiments (refer to FIGS. 1, 6 and 7). Further, though not shown in figures, the second locking face of the socket to be connected to the plug 2 of the second modification extends more downwardly than the second locking face 36 of the first modification (refer to FIGS. 1, 6 and 7).

With such an arrangement, since the positions of the second locked face 26B and the second locking face 36 in the vertical direction are lower than the positions of the second locked face 26 and the second locking face 36 of the first embodiment, the bending moment generated by the second locked face 26B becomes larger. Thus, since the deformation of the tongue-like portion 22, 22B caused by the bending moment and the inclination of then plug 2 with respect to the socket 3 become smaller, the buckle 1 becomes difficult to disconnect.

In the first and second embodiments, the socket 3 is provided with the socket through hole 314, and when the buckle 1, 1A is connected, the first projected portion 23 is exposed to the outside from the upper opening 312. However, the present invention also includes such arrangement in which a cover or the like having enough elasticity in the vertical direction may be provided to cover the upper opening 312. Since the cover or the like has enough elasticity in the vertical direction, the first projected portion 23 can be pressed from the cover or the like, so that no hindrance will be caused to the operability of the buckle 1, 1A. With such an arrangement, since the upper opening 312 is covered by the cover or the like, a foreign object can be prevented from entering into the socket 3, therefore improving the operability of the buckle 1, 1A.

INDUSTRIAL APPLICABILITY

The present invention can be applied to a front release type buckle.

The invention claimed is:

1. A buckle having a plug and a socket connected to each other in a predetermined connecting direction, wherein the plug includes a plug body, a tongue-like portion extending from the plug body, and a first projected portion projecting from the tongue-like portion and having a first locked face formed thereon, the first locked face crossing the connecting direction; the socket includes a socket body, an insertion hole provided in the socket body and into which the tongue-like portion is inserted, and a first stepped portion provided at the insertion hole and having a first locking face formed thereon, the first locking face crossing the connecting direction and engaging with the first locked face; the buckle comprising:

a second projected portion projecting from the tongue-like portion and having a second locked face formed thereon, the second locked face crossing the connecting direction; and a second stepped portion provided at the insertion hole and having a second locking face formed thereon, the second locking face crossing the connecting direction and engaging with the second locked face, wherein either of the first and second locked faces and the first and second locking faces are concave as extending from the plug toward the socket and are in a curved surface shape having the same center, the other of the first and second locked faces and the first and second locking faces are convex as extending from the plug toward the socket and are in a curved surface shape having the same center, and the first locked face and the first locking face have substantially the same curvature, and the second locked face and the second locking face have substantially the same curvature.

2. The buckle according to claim 1, wherein a first inclined face is formed on the first locked face, the first inclined face inclining toward a side opposite a socket side as it goes away from the tongue-like portion along a projecting direction of the first projected portion; and a second inclined face is formed on the first locking face, the second inclined face inclining toward a plug side as it goes away from the insertion hole along the projecting direction of the first projected portion.

3. The buckle according to claim 1, further comprising: a holding piece extending from the socket body toward the plug body; and a receiving face provided on the plug body and fitted by the holding piece in a state of opposing the projecting direction of the first projected portion.

* * * * *